United States Patent [19]

Saint

[11] Patent Number: 4,589,657

[45] Date of Patent: May 20, 1986

[54] INFANT SWING CARRIAGE SUPPORT

[75] Inventor: David Saint, Elverson, Pa.

[73] Assignee: Graco Metal Products, Inc., Elverson, Pa.

[21] Appl. No.: 583,279

[22] Filed: Feb. 27, 1984

Related U.S. Application Data

[63] Continuation-in-part of Ser. No. 466,176, Feb. 14, 1983, abandoned.

[51] Int. Cl.[4] ..... A63G 9/00

[52] U.S. Cl. ..... 272/85

[58] Field of Search ..... 272/85, 86, 87, 88, 272/89, 90, 91, 92, 54, 55; 446/322, 323; 297/247, 273, 274, 275, 276, 277, 278, 279, 280, 281, 282, 130; 248/317, 324, 341

[56] References Cited

U.S. PATENT DOCUMENTS

| | | | |
|---|---|---|---|
| 505,485 | 9/1893 | Scearce | 272/54 |
| 1,233,866 | 7/1917 | Gibbs | 446/322 |
| 4,271,627 | 6/1981 | Echterling | 272/85 X |

*Primary Examiner*—Robert E. Bagwill
*Assistant Examiner*—Arnold W. Kramer
*Attorney, Agent, or Firm*—Seidel, Gonda, Goldhammer & Abbott

[57] ABSTRACT

A swing carriage is supported by a frame for oscillation by mating structures at each end thereof. Each mating structure includes an inverted V-shaped projection having a rounded apex in line contact with a generally straight top edge of a hole.

19 Claims, 11 Drawing Figures

FIG. 1
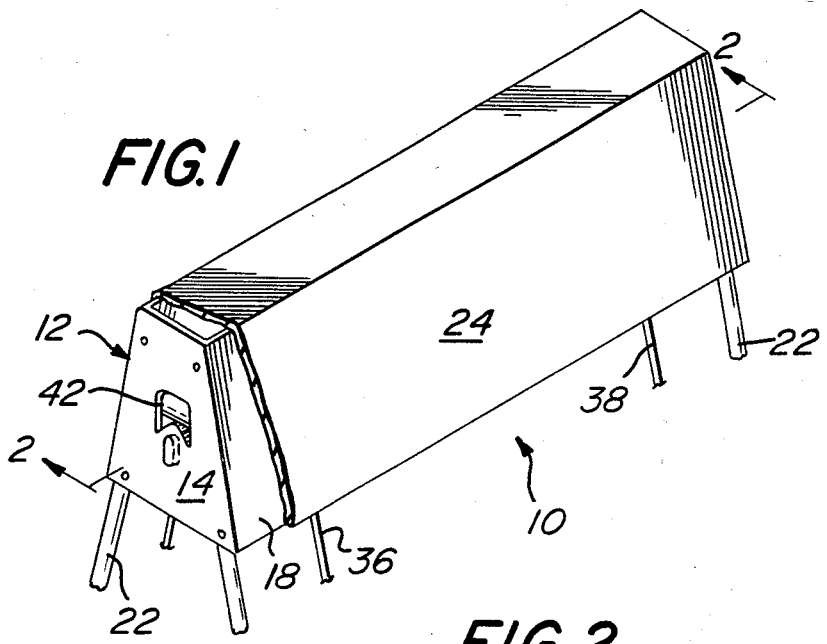
FIG. 2
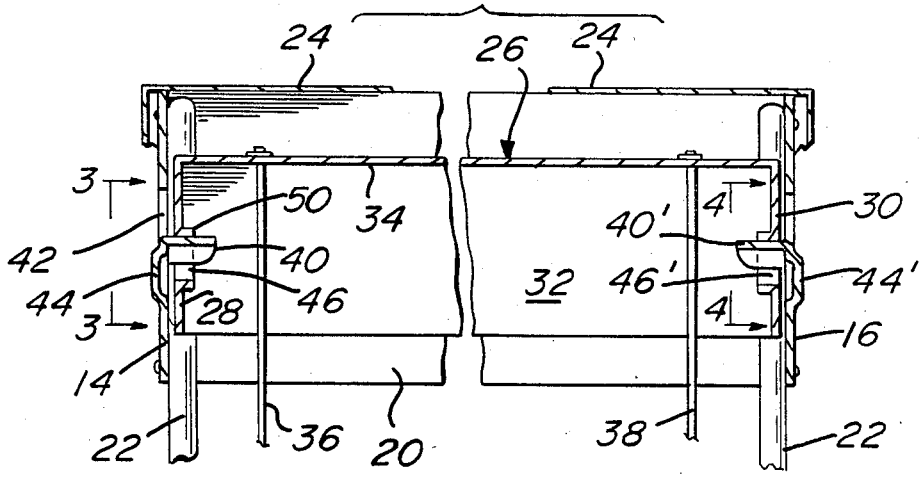
FIG. 4
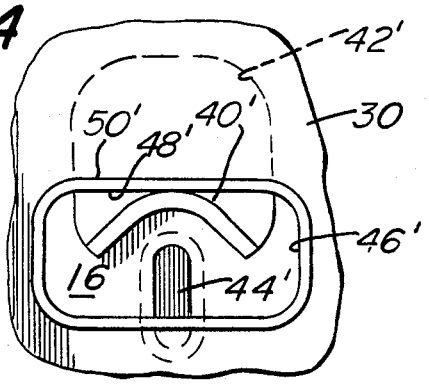
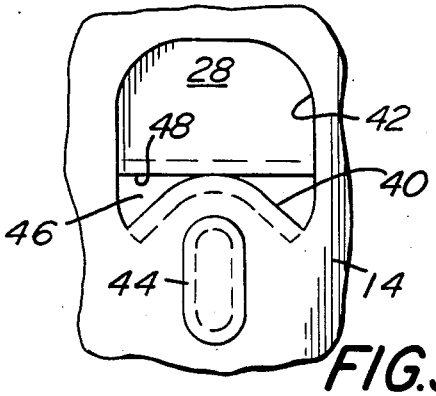
FIG. 3

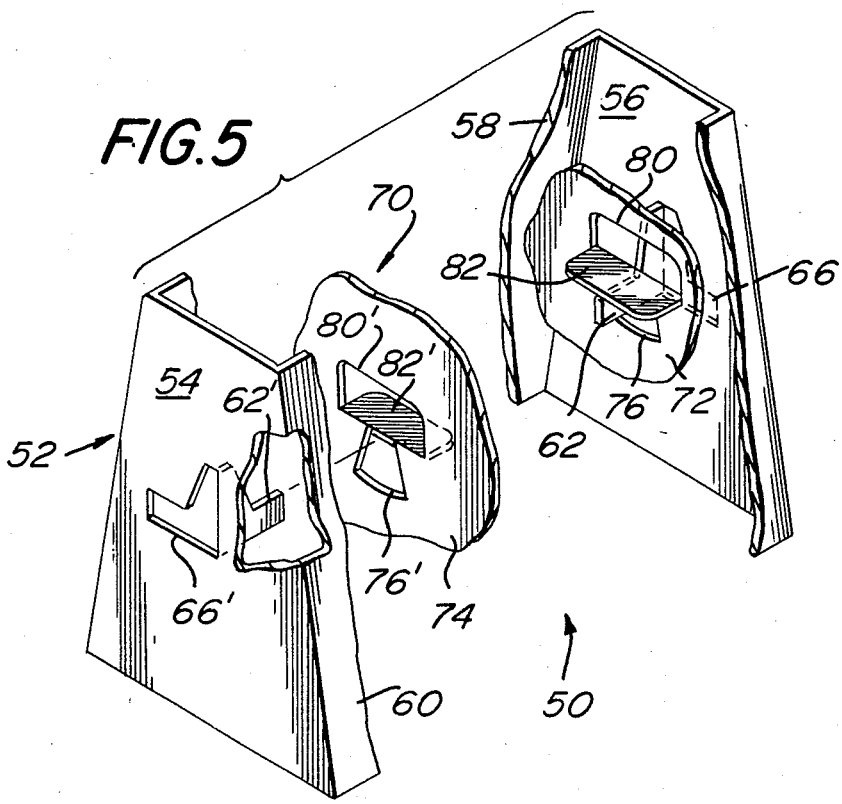
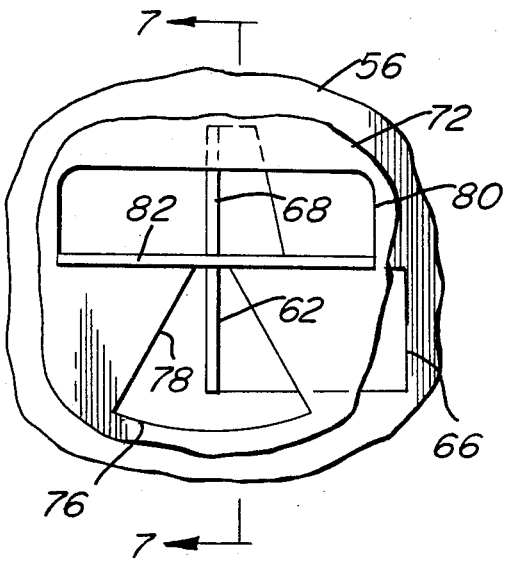
FIG.6
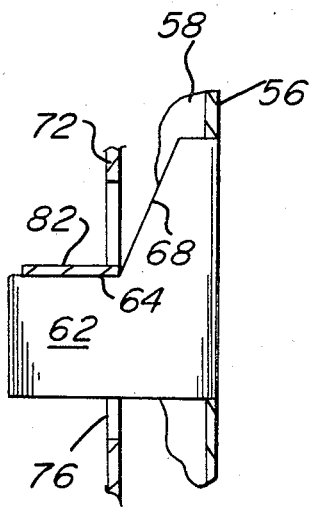
FIG.7

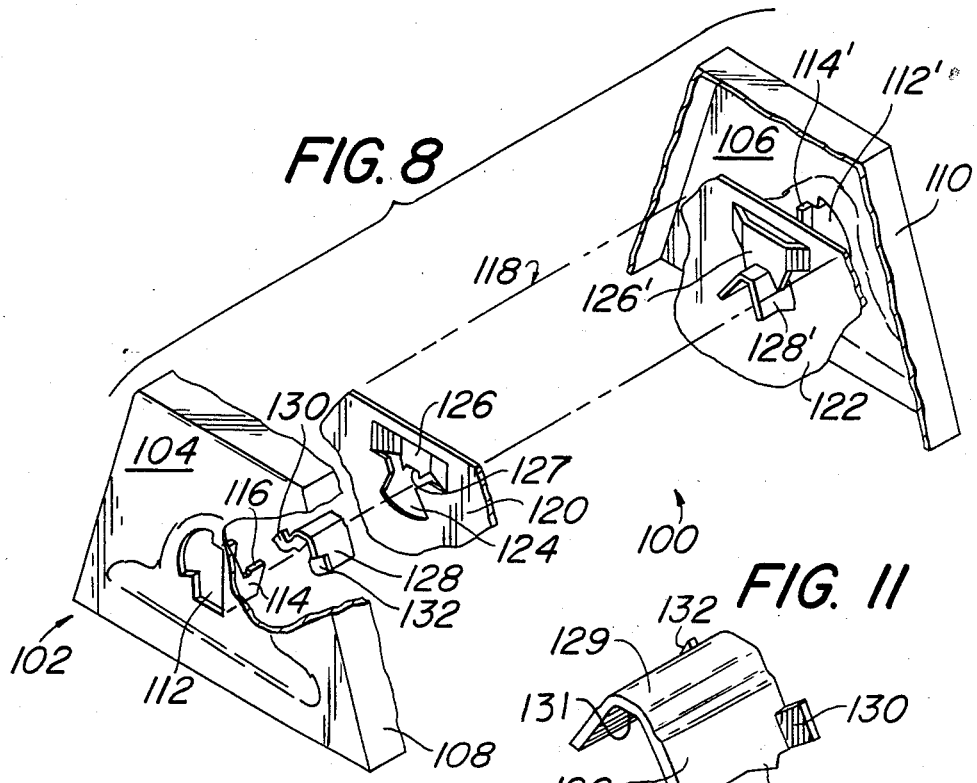
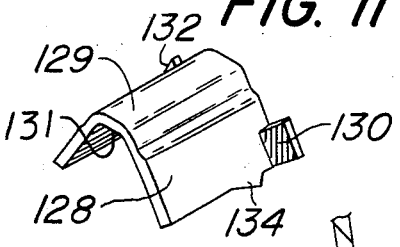
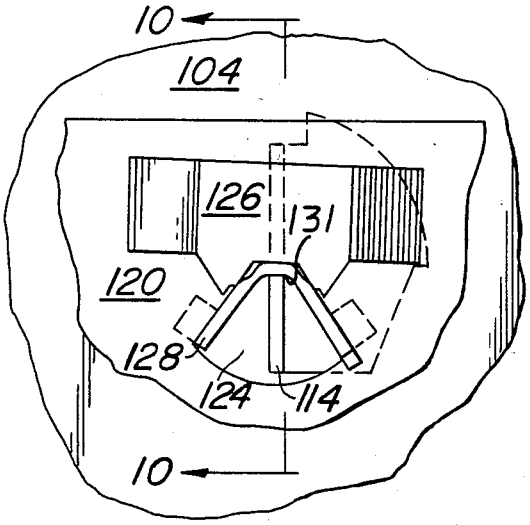
FIG. 9
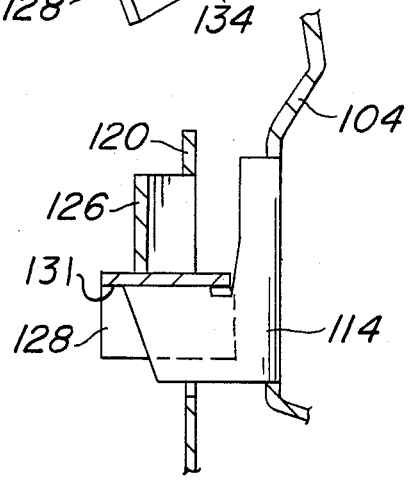
FIG. 10

INFANT SWING CARRIAGE SUPPORT

This application is a continuation-in-part, of application Ser. No. 466,176, filed Feb. 14, 1983, and now abandoned.

BACKGROUND OF THE INVENTION

The carriage of an infant swing is usually supported from a frame by way of a main shaft and bearings on the frame for the ends of the shaft. The present invention is directed to a solution of the problem of how to minimize friction between the carriage and frame and how to support the carriage on the frame with a minimum number of components to thereby reduce the cost and inventory of parts.

SUMMARY OF THE INVENTION

In a swing, there is provided a frame which supports a carriage for oscillation about a horizontal axis. The carriage is supported at each end thereof on the frame by sets of mating structures. Each set of mating structure includes a projection having a generally horizontal top edge and projecting from the frame into a hole on the carriage.

Various objects and advantages of the present invention will appear hereinafter.

For the purpose of illustrating the invention, there is shown in the drawings a form which is generally preferred; it being understood, however, that this invention is not limited to the precise arrangements and instrumentalities shown.

FIG. 1 is a perspective view of the upper end of an infant swing.

FIG. 2 is a sectional view taken along the line 2—2 in FIG. 1.

FIG. 3 is an end view taken along the line 3—3 in FIG. 2 but on an enlarged scale.

FIG. 4 is an end view taken along the line 4—4 in FIG. 2 but on an enlarged scale.

FIG. 5 is a partial exploded view of the mating parts of the frame and carriage in accordance with another embodiment of the invention.

FIG. 6 is an elevation view of the right side of FIG. 5 as seen from inside the carriage.

FIG. 7 is a sectional view taken along the line 7—7 in FIG. 6.

FIG. 8 is a partial exploded view of the mating parts of the frame and carriage in accordance with a third embodiment of the invention.

FIG. 9 is an elevation view of the right side of FIG. 8 as seen from inside the carriage.

FIG. 10 is a sectional view taken along the line 10—10 in FIG. 9.

FIG. 11 is a perspective view of the rocker member used in the third embodiment of the invention.

DETAILED DESCRIPTION

Referring to the drawing in detail, wherein like numerals indicate like elements, there is shown in FIG. 1 the upper end of an infant swing 10 in accordance with a first embodiment of the present invention. The swing 10 includes a frame 12 defined by end walls 14 and 16 interconnected together by any convenient or suitable structure such as side walls 18 and 20. Frame 12 is made from sheet metal.

The frame 12 is provided with legs 22 at each end thereof. Each of the legs 22 are defined by upwardly converging tubular members connected together at a bight. The tubular members are secured to the end walls 14 and 16 in any convenient manner such as by threaded fasteners, riveting, etc. Exposure of movable components at the end walls represents a possible area of injury to infants. Accordingly, the swing 10 may include a removable cover 24 of sheet metal or plastic. Cover 24 overlies the open top end of the frame 12 and overlies the end walls 14 and 16 to limit access to the movable components and thereby add a safety feature.

Within the frame 12 there is provided a carriage 26. Carriage 26 is supported by the frame 12 for oscillation about a horizontal axis. Carriage 26 may assume a wide variety of configurations so long as it has an end wall 28 juxtaposed to end wall 14 and an end wall 30 juxtaposed to end wall 16. The end walls 28, 30 are preferably interconnected by side walls 32 and a top wall 34. Top wall 34 facilitates supporting the hangers 36, 38. A seat, not shown, is connected to the hangers 36, 38. Oscillation of the carriage 26 is preferably accomplished by an electrimotor, not shown. A wide variety of motors are known to those skilled in the art for oscillating the carriage 26.

The carriage 26 is supported by the frame 12 for oscillation by mating structures at each end thereof. The mating structures associated with walls 14 and 28 will be described in detail with corresponding prime numerals being provided for the corresponding structure at the opposite end of the swing 10.

One of the walls 14 and 28 has a projection and the other has a mating recess. In the illustrated preferred embodiment, projection 40 extends inwardly from the wall 14. Projection 40 is attained by punching out and forming a portion of the wall 14. The opening 42 results from the punching operation. The projection 40 is an inverted V-shaped member with a rounded apex. See FIGS. 3 and 4. The wall 14 beneath projection 40 is provided with a reinforcement in the form of a indentation 44. Indentation 44 preferably has the shape as shown in FIGS. 3 and 4. Indentation 44 sufficiently reinforces the wall 14 beneath the projection 40 so as to maintain projection 40 rigid.

Wall 28 is provided with an opening 46 defined by inwardly extending flange 50. Opening 46 is generally rectangular with rounded corners. The top edge of the opening 46 is designated 48. Edge 48 is generally horizontal and in line contact with the rounded apex of the projection 40. Thus, the carriage is supported by the projections 40, 40' without any transverse shaft or bearings. The coupling of the carriage to the frame does not involve any separate discrete parts which must be inventoried. All of the structure for coupling the carriage 26 to the frame 12 is attained by cutting or punching out a portion of the juxtaposed walls 14, 28. Thus, the coupling is simple, inexpensive, and easy to fabricate.

The converging legs of the V-shaped projection 40 and 40' preferably are disposed at an angle of approximately 45 degrees with respect to the horizontal. The carriage 26 preferably oscillates 30 degrees to each side of a vertical center line through the apexes of the projections 40, 40' by means of the motor, not shown. The straight edges 48, 48' of openings 46, 46' remain in line contact with the apexes of projections 40, 40' as the carriage oscillates. The pendular force is always perpendicular to the straight edge 48. The end walls on the cover 24 overly the openings 42, 42' so that said openings are not exposed and do not constitute an area of potential injury to the fingers of an infant. The cover 24 further prevents foreign objects from being inserted through the holes 42, 42'.

In FIGS. 5–7, there is illustrated a second embodiment of the present invention wherein the swing is designated generally as 50. The swing 50 is identical with swing 10 except as will be made clear hereinafter. Swing 50 includes a frame 52 having end walls 54 and 56 interconnected by any suitable structure such as side walls 58 and 60.

Mating structures are provided at each of the end walls of the swing 50. Only the structure at the right hand end of FIG. 5 will be described in detail with corresponding prime numerals being provided for the same structure on the left hand end of FIG. 5.

A hole 66 is struck in the end wall 56 thereby producing a projection 62 having a horizontally disposed top edge 64 and an inclined surface 68. See FIG. 7. A carriage 70 has end walls 72, 74. A first hole 76 is provided in the end wall 72 and the resulting disk is removed. Hole 76 has sides 78 which converge upwardly toward an apex and resembles a truncated segment.

A second hole 80 is struck in the end wall 72 with the resulting projection 82 being integral therewith at one end thereof. Projection 82 is horizontally disposed and rests on the top edge 64 of the projection 62. Projection 62 extends through the hole 76. The swing angle for the carriage 70 is determined by the sides 78 of hole 76 which act as limit stops. Swing 50 is otherwise identical with swing 10.

In FIGS. 8–11, there is illustrated a third embodiment of the present invention wherein the swing is designated generally as 100. The swing 100 is identical with swings 10 and 50 except as will be made clear hereinafter. Swing 100 includes a frame 102 having end walls 104 and 106 interconnected by any suitable structure such as side walls 108 and 110.

Mating structures are provided at each of the end wall of the swing 100. Only the structure at the lefthand end of FIG. 8 will be described in detail, with corresponding prime numerals being provided for the same structure on the righthand end of FIG. 8.

A hole 112 is struck in the end wall 104, thereby producing a projection 114 having a horizontally disposed top edge 116. See FIG. 10. A carriage 118 has end walls 120 and 122. A first hole 124 is struck in carriage end wall 120, and a portion of the material is removed. The remaining portion of material forms a projection 126, which has a generally horizontal bottom edge 127. A rocker member 128 (see FIG. 11) is inserted into hole 124 in end wall 120. Rocker member 128 has a top surfce 129 which contacts horizontal surface 127 of projection 126. Rocker member 128 is provided with tabs 130 and 132 and projection 134 to enable rocker member 128 to be positioned and held in hole 124.

Rocker member 128 also has a bottom surface 131, which is in line contact with the top edge 116 of projection 114. Carriage 118 is thus supported for oscillation by rocker members 128, 128' and projections, 116, 116'. The swing angle for the carriage 118 is limited by the sides of rocker member 128, which act as limit stops. Swing 100 is otherwise identical to swings 10 and 50.

The present invention may be embodied in other specific forms without departing from the spirit or essential attributes thereof and, accordingly, reference should be made to the appended claims, rather than to the foregoing specification, as indicating the scope of the invention.

I claim:

1. In a swing comprising a frame having end walls at opposite ends thereof, a carriage having end walls at opposite ends thereof, said carriage being supported by the frame end walls for oscillation about a horizontal axis by discrete sets of mating structures, each set of mating structures including a short projection integral in one piece and struck from a frame end wall, each projection extending horizontally from said frame end wall into a projection receiving means in the adjacent carriage end wall so that the carriage is supported by a horizontal surface of said projection, each projection being in line contact along said horizontal surface with said projection receiving means, and means for suspending a swing seat from said carriage.

2. In a swing in accordance with claim 1 wherein said projection receiving means has sides which converge upwardly.

3. A swing in accordance with claim 1 wherein each set of mating structure includes an inwardly extending generally horizontal projection on the carriage end walls adjacent a periphery of said projection receiving means and in line contact with the frame projection.

4. A swing in accordance with claim 1, said projection being a horizontally extending inverted V-shaped projection having a rounded apex in line contact with said projection receiving means, said projection receiving means being a hole provided in the end wall of said carriage.

5. A swing in accordance with claim 4 including a cover overlying the end walls of the frame.

6. A swing in accordance with claim 4 wherein each hole is rectangular with the major sides thereof being horizontally disposed when the carriage is stopped.

7. A swing in accordance with claim 4 wherein each hole is defined by the inner peripheral surface of an annular flange projecting inwardly from the end walls of the carriage.

8. A swing in accordance with claim 1, said projection receiving means including a hole into which the projection extends, said projection being generally L-shaped in elevation.

9. In a swing in accordance with claim 8 wherein each of said holes has sides which converge upwardly.

10. In a swing in accordance with claim 9 wherein said mating structure includes a horizontally disposed projection struck from end walls of the carriage and overlying the staight edges of the associated projections on the frame end walls.

11. In a swing in accordance with claim 1 wherein said projection receiving means is a hole.

12. A swing in accordance with claim 11 wherein said hole is rectangular.

13. In a swing in accordance with claim 1 wherein said projection receiving means comprises said adjacent carriage end wall having a hole and a rocker member disposed within said hole.

14. In an infant swing comprising a frame supported by legs, said frame having end walls, a carriage having end walls supported by the frame for oscillation about a horizontal axis, said carriage being between said frame end walls, means on the frame and carriage end walls for supporting the carriage for such oscillation without a separate discrete bearing, said means including mating structure on juxtaposed end walls of the frame and carriage, said mating structure including a short projection integral in one piece and struck from a frame end wall, said projection being generally L-shaped in elevation and having a horizontal top edge, said mating structure including a hole in the adjacent end of the carriage and into which the projection extends, said mating structure further including a rocker member disposed between an edge of said hole and said projection, the top edge of said projection being in line contact with the underside of said rocker member, and the top surface of said rocker member being in contact with said edge of said hole.

15. In a swing in accordance with claim 14, wherein each of said rocker members has sides which converge upwardly.

16. In a swing in accordance with claim 15, wherein said sides converge upwardly and form an apex which is generally flat and horizontally disposed when the carriage is stopped.

17. In a swing in accordance with claim 16, wherein each of said holes has sides which converge upwardly and form an apex which is generally flat and horizontal, such that said hole resembles a truncated sector.

18. In a swing in accordance with claim 16, wherein at least one curved portion formed between said sides and said apex is adapted for receiving said projection for oscillation thereon.

19. In a swing in accordance with claim 16, wherein said apex has a width slightly larger than the width of said projection, whereby said projection is substantially self aligning with said apex.

* * * * *